United States Patent [19]

Link

[11] Patent Number: 4,971,317

[45] Date of Patent: Nov. 20, 1990

[54] UNDERWATER EXERCISE APPARATUS

[75] Inventor: Paul A. Link, Wisconsin Rapids, Wis.

[73] Assignee: Pal Products, Inc., Wisconsin Rapids, Wis.

[21] Appl. No.: 427,782

[22] Filed: Oct. 27, 1989

[51] Int. Cl.[5] ..... A63B 21/00

[52] U.S. Cl. ..... 272/73; 272/1 B

[58] Field of Search ..... 272/73, 72, 71, 70, 272/1 B, 130, 93; D21/194; D34/5

[56] References Cited

U.S. PATENT DOCUMENTS

| | | | |
|---|---|---|---|
| D. 158,675 | 5/1950 | Longfellow | D34/5 |
| D. 209,065 | 10/1967 | Weiss | D34/5 |
| D. 219,663 | 1/1971 | Thompson | D21/3 |
| D. 227,278 | 6/1973 | Arato | D21/92 |
| D. 272,478 | 2/1986 | Williams | D21/194 |
| D. 281,710 | 12/1985 | Kirby | D21/194 |
| 563,578 | 7/1896 | Emerson | 272/71 |
| 2,190,895 | 2/1940 | Turpin | 272/57 |
| 2,388,777 | 11/1945 | Wentz | 272/73 |
| 2,673,088 | 3/1954 | Wentz | 272/73 |
| 3,704,682 | 12/1972 | Piccitto | 272/73 |
| 3,968,963 | 7/1976 | Sileo | 272/73 |
| 4,218,056 | 8/1980 | Whitling | 272/71 |
| 4,776,581 | 10/1988 | Shepherdson | 272/69 |
| 4,828,522 | 5/1989 | Santos | 441/129 |

*Primary Examiner*—Stephen R. Crow

*Attorney, Agent, or Firm*—Foley & Lardner

[57] ABSTRACT

An aquatic exercise apparatus for providing underwater cycling motions comprising a longitudinal support member with a pair of pedals connected to a single shaft which is journaled to an underwater bearing. A pair of cross-members support the apparatus on the bottom surface of a water receptacle and a plurality of suction cups are provided for attachment with the bottom surface.

3 Claims, 3 Drawing Sheets

UNDERWATER EXERCISE APPARATUS

Technical Field

The present invention relates, generally, to underwater exercise apparatus, and more particularly, to a cycling apparatus of the type having a frame for supporting a bearing through which a pedal shaft is journaled.

BACKGROUND ART AND TECHNICAL PROBLEMS.

Cycling apparatus for use in exercise and therapy are generally well known. See, for example, Wentz U.S. Pat. No. 2,673,088 issued Mar. 23, 1954; Wentz U.S. Pat. No. 2,388,777 issued Nov. 13, 1945; Williams U.S. Pat. No. D282,478 issued Feb. 4, 1986; and Weiss U.S. Pat. No. D209,065 issued Oct. 31, 1967. Each of the foregoing devices include various mechanical apparatus which focus upon various physiological aspects of cycling. As a result, the weight, cost, size, and complexity of the devices render the transportation, setup, and storage thereof unduly cumbersome.

Cycling appartus employing a minimum of frame, base, and support structure are also well known. See, for example, Kirby U.S. Pat. No. D281,710 issued Dec. 10, 1985; Aratous U.S. Pat. No. D227,278 issued June 12, 1973; Longfellow U.S. Pat. No. D158,675 issued May 23, 1950; Thompson U.S. Pat. No. D219,663 issued Jan. 5, 1971; and Turpin U.S. No. Pat. No. 2,190,895 issued Feb. 20, 1940. However, because of the nature of the base and support mechanisms of the foregoing devices, they are unsuitable for underwater use.

Aquatic exercise devices are also known. See, for example, Piccittous U.S. Pat. No. 3,704,682 issued Dec. 5, 1972; Shepherdson U.S. Pat. No. 4,776,581 issued Oct. 11, 1988; and Santosus U.S. Pat. No. 4,828,522 issued May 9, 1989. While these devices are specifically designed for use in conjunction with an underwater environment, they are not readily transportable and impractical for use in a conventional spa.

SUMMARY OF THE INVENTION

The present invention provides a sturdy, lightweight, compact, easily transportable cycling apparatus which overcomes various shortcomings associated with the prior art.

In accordance with one aspect of the present invention, a unitary frame, having a single longitudinal support member, supports a bearing adapted for underwater use. A pair of pedals are connected by a single shaft, which shaft is journaled through the underwater bearing. Due to the inherent resistance assoiciated with an underwater environment, a relatively loose fitting bearing provides adequate resistance for moderate levels of exercise.

The present invention is particularly well adapted for use in a pool or spa, for example, in a small enclosure of the type typically employed in residential homes.

In accordance with another aspect of the present invention, a pair of cross members are mounted transverse to the support member for supporting the cycle on the bottom surface on the underwater cavity within which the cycle is used. More particularly, a plurality of suction cups extend downwardly from the cross members to stabilize the apparatus against the smooth spa floor.

In accordance with yet another aspect of the invention, the therapeutic value of the cycle is enhanced to the extent the operator's limbs and joints may be immersed in a warm, fluidic environment during exercise.

BRIEF DESCRIPTION OF THE DRAWINGS

The present invention will hereinafter be described in conjunction with the appended drawings, wherein like designations denote like elements, and.

DETAILED DESCRIPTION OF PREFERRED EXEMPLARY EMBODIMENTS

Figure 1:
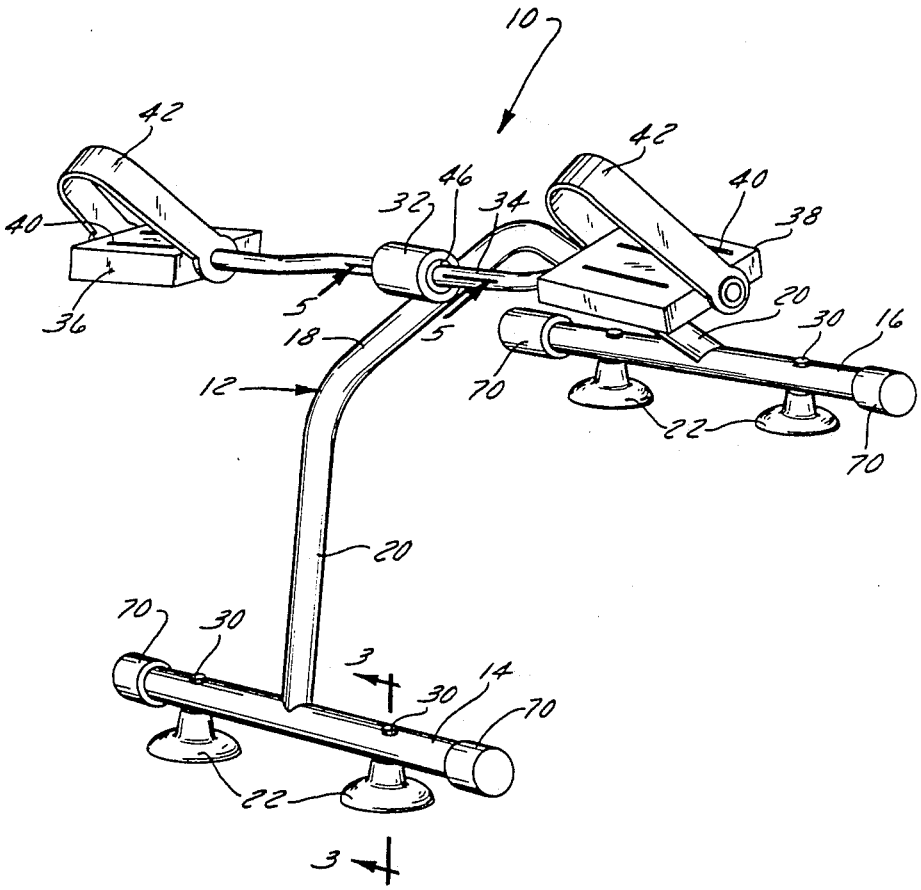
FIG. 1 is a perspective view of a first embodiment of an exemplary aqua cycle in accordance with the present invention.

Referring now to FIG. 1, an exercise cycle 10 in accordance with the present invention suitably comprises a support member 12, including a top portion 18 and respective extensions 20. Respective cross members 14 and 16 are advantageously rigidly secured to the distal ends of extensions 20. Preferably, cross members 14 and 16 are secured by means of bolts 17 and corresponding nuts (not shown).

In the illustrated embodiment, cross members 14 and 16 are generally orthogonal to support member 12. A plurality of stabilizers 22 are advantageously secured to cross members 14 and 16 to facilitate attachment of cycle 10 to an underwater surface of an aquatic chamber.

In a particularly preferred embodiment, suction cups 22 are configured to permit cycle 10 to be conveniently disposed within a swimming pool or health spa on some surface thereof. Conventional health spas typically include molded seating, for example a bench configured about the perimeter of the spa, formed integral with the spa walls. Thus, cycle 10 may be conveniently installed on the smooth bottom surface of the spa at a desired distance from the molded seat such that the operator's feet can manipulate the pedals with optimum leg extension.

Many conventional spas further include a whirlpool mechanism comprising one or more forced air outlets or high speed water jets, for example, to produce strong local currents within the aquatic environment. Consequently, it is desireable to firmly secure cycle 10 to the bottom of the pool to stabilize the apparatus.

Figure 3:
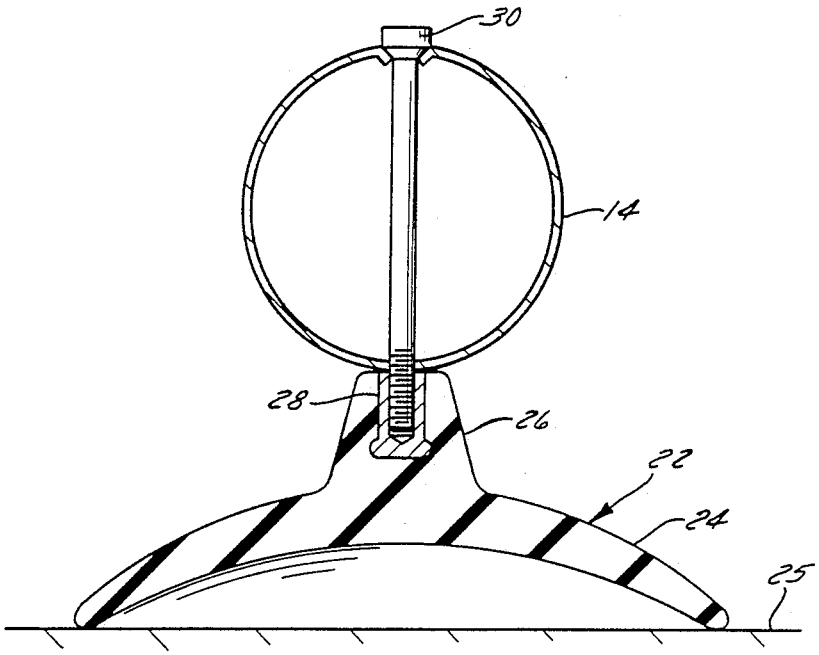
FIG. 3 is a cross section view, taken along line 3—3 in FIG. 1, of a suction cup in accordance with the present invention.

Referring now to FIG. 3, suction cups 22 may be secured to cross members 14 and 16 in any convenient manner, for example through the use of a fastener assembly combination. Preferably, a fastener 30, for example a screw, bolt, or the like, extends transversely through cross member 14 and engages neck portion 26 of stabilizer 22. In a preferred embodiment, neck portion 26 suitably includes a threaded insert 28 for mating engagement with the distal end of fastener 30.

Suction cup 22 beneficially comprises a bell portion 24 and a neck portion 26. Bell portion 24 is of a larger diameter than neck portion 26 and serves to demountably affix cycle 10 to a surface 25 of a spa or other aquatic chamber. Preferably, surface 25 comprises the floor of a conventional health spa. Stabilizers 22 advantageously comprise suction cups, made for example from plastic, rubber, polyethylene, polypropylene, various copolymers thereof, and the like.

Returning now to FIG. 1, top portion 18 is configured to support a bearing 32 having a pedal shaft 34 journaled therethrough. Respective pedals 36 and 38 are rotatably secured to the oppositely disposed distal ends of pedal shaft 34 in a conventional matter. Respective pedals 36 and 38 suitably include a retaining strap 42 and, a foot pad 40 advantageously made from a soft, pliable, material, for example, nylon, plastic, rubber, or the like.

Figure 4:
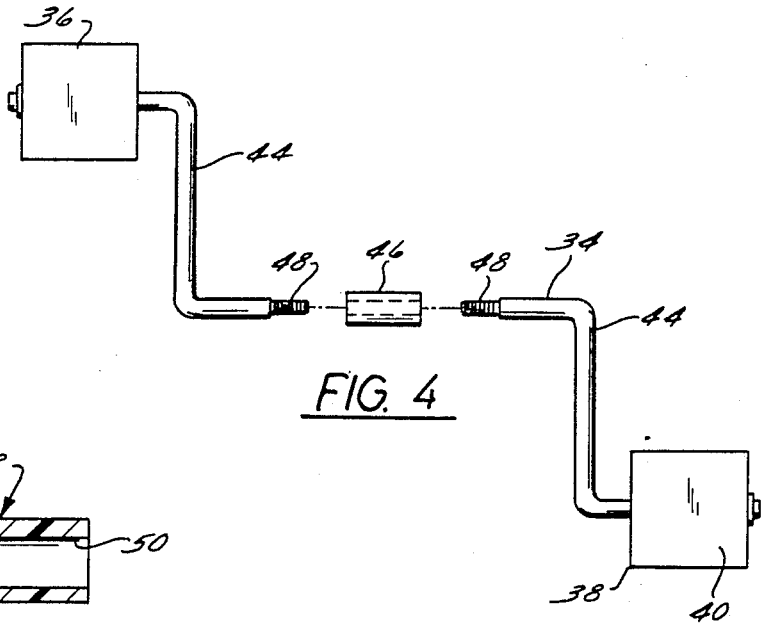
FIG. 4 is an exploded view of the pedal mechanism in accordance with the present invention.

Referring now to FIG. 4, pedal shaft 34 is preferably in the configuration of a double rod crank, and suitably comprises respective angled portions 44 joined at a collar 46. Respective angled portions 44 suitably include respective threaded members 48 at the distal ends thereof. Collar 46 suitably comprises a generally cylindrical shaft having respective internally threaded ends configured to receive respective threaded members 48. It should be appreciated that any suitable connection device for joining portions 44 is appropriate and is considered within the scope of this invention.

Figure 5:
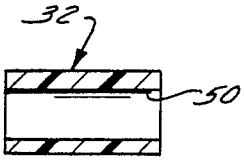
FIG. 5 is a cross section view, taken along line 5—5 in FIG. 1, of an exemplary bearing in accordance with the present invention.

Referring now to FIG. 5, bearing 32 suitably comprises a smooth internal bore 50 extending therethrough. The surface of bore 50 is advantageously made from a durable material, for example, nylon, polypropylene, polyethylene, various copolymers thereof, plastic, or any suitable material exhibiting high lubricity and good wear characteristics.

With reference now to FIGS. 4 and 5, assembly of the pedal mechanism entails securely fastening collar 46 to one of threaded members 48. Thereafter, collar 46, with threaded member 48 threadedly engaged therewith, is inserted into one end of bore 50 of bearing 32. Thereafter, the oppositely disposed angled portion 44 is aligned with bore 50 and threaded portion 48 inserted thereinto until mating engagement with collar 46 is established. By holding one of pedals 36 and 38 securely and rotating the other pedal with respect thereto, both threaded portions 48 may be secured within collar 46. Because of the high lubricity associated with bore 50, further lubrication is unnecessary. Furthermore, any heat which may be generated as a result of the friction between shaft 34 and bearing 32 is quickly dissipated, especially in an aquatic environment.

Referring again to FIG. 1, bearing 32 may be secured to top portion 18 in any convenient manner, for example with an adhesive, nut and bolt combination, or through any conventional fastening means. Alternatively, bearing 32 may be formed integral with top portion 18, as discussed below.

Figure 2:
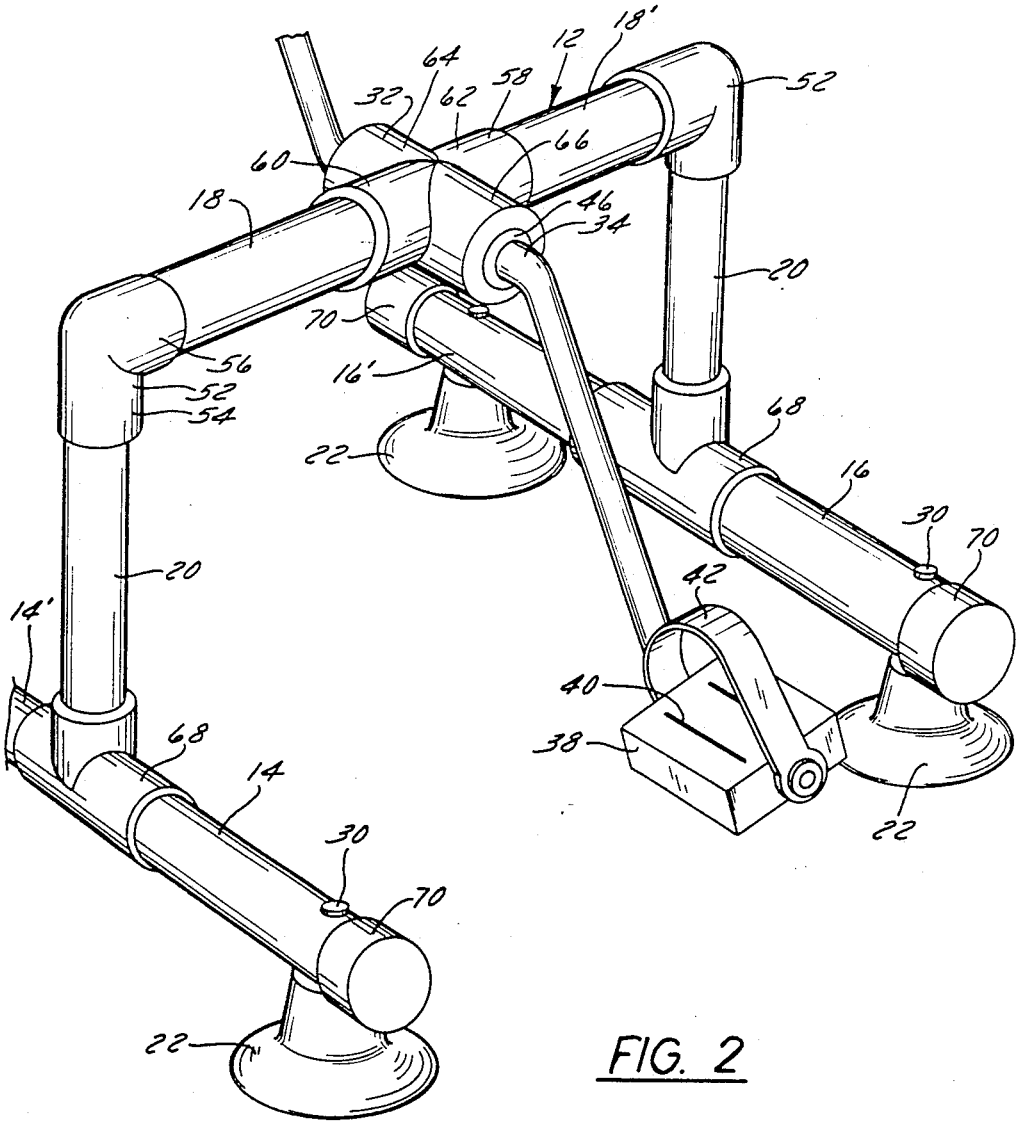
FIG. 2 is a perspective view of an alternate embodiment of an aqua cycle in accordance with the present invention.

Referring now to FIG. 2, an alternate exemplary embodiment of cycle 10 illustratively includes a support 12 having top portion 18, respective extensions 20 extending therefrom, and respective cross members 14 and 16 disposed at the distal ends of respective extensions 20. A plurality of stabilizers 22 suitably extend downwardly from respective cross members 14 and 16. Preferably, two stabilizers 22 are secured to each cross member 14 and 16, for example, one stabilizer 22 on each side of extension 20.

With continued reference to FIG. 2, top portion 18 is secured to extension 20 at a first elbow 52. Elbow 52 suitably comprises respective first and second female connectors 54 and 56 for receiving extension 20 and top portion 18 therewithin. In accordance with one aspect of the present invention, one or more of first elbow 52, top portion 18, extension 20, and cross member 14 may comprise conventional plumbing tubing, and may be made from polypropylene, polyethylene, various copolymers thereof, plastic, or any suitable material compatible with an aquatic environment. Furthermore, the foregoing components advantageously comprise hollow cylindrical members so that cycle 10, when immersed in a spa, will become filled with water. This eliminates the buoyancy associated with the lightweight components and allows the apparatus to be securely fastened to the bottom of the spa.

With continued reference to FIG. 2, bearing 32 is advantageously formed integrally with a four-way connector 58. Connector 58 illustratively includes respective third, fourth, fifth, and sixth female connectors 60, 62, 64, and 66.

In the embodiment shown in FIG. 2, top portion 18 illustratively comprises two separate components 18 and 18, In this manner, the respective distal ends of top portions 18 and 18, are connected to respective first elbows 52. The respective proximal ends of respective top portions 18 and 18' are suitably received within first and second female connections 60 and 62, respectively. In this manner, bearing 32 suitably comprises a bore 50 (not shown in FIG. 2; see FIG. 5 above) extending therethrough for rotatably supporting pedal shaft 34.

With continued reference to FIG. 2, respective second elbow connections 68 are illustratively configured to connect cross members 14 and 16 to respective extensions 20. Cross member 14 may comprise a single member extending through second elbow connector 68. Alternatively, cross member 14 may comprise two separate portions 14 and 14', each of which may be conveniently received within respective opposing ends of connector 68. Similarly, cross member 16 may comprise one or two segments, as desired.

Referring now to FIGS. 1 and 2, a plurality of end caps 70 are advisably secured to the free ends of cross members 14 and 16 to prevent discomfort and injury to the operator in the event the ends of cross members 14 and 16 are inadvertantly kicked or stepped on. End caps 70 may be made from any suitable material, for example, plastic, rubber, or the like.

In operation, a user applies force to the pedals 36 and 38 in a conventional bicycling fashion. Shaft 34 is thus caused to rotate with respect to top portion 18 of the support member 12 through bore 50 of bearing 32. When cycle 10 is utilized in an aquatic environment such as when it is demountably affixed by stabilizers 22 to the surface 25 of a covnentional health spa, the water provides increased resistance, thus promoting increased muscular development and improved cariovascular benefits.

It will be understood that the above description is of preferred exemplary embodiments of the present invention, and that the invention is not limited to the specific forms shown. Various modifications may be made in the design and arrangement of the elements within the scope of the invention as expressed in the appended claims.

I claim:

1. An exercise cycle for use in an aquatic chamber, comprising:

a support bar having a first end, a second end, and a bearing mounted thereto between said first and second ends, said bearing comprising an internal bore extending therethrough and having a longitudinal axis disposed transverse to said support bar;

a first cross member having a first pair of oppositely disposed end portions, secured to said first end of said support bar, and a second cross member having a second pair of oppositely disposed end portions, secured to said second end of said support bar;

a first pair of suction assemblies secured to said first pair of oppositely disposed end portions, respectively, and a second pair of suction assemblies secured to said second pair of oppositely disposed end portions, respectively;

at least one of said suction assemblies comprising:

a resiliently deformable suction cup including a bell-shaped portion configured for demountable attachment to a smooth floor of said aquatic chamber and a neck portion extending upwardly from said bell-shaped portion;

an annular inert, embedded within said neck portion and having screw threads disposed on an interior surface thereof; and an elongated fastener extending through at least a portion of one of said oppositely disposed end portions of one of said first and second cross members and threadedly engaging said insert to thereby secure said suction assembly to said cross member;

a pedal assembly including:

respective first and second crank members each having a first end about which a pedal is rotatably mounted and a second end comprising an externally threaded member; and a collar including respective oppositely disposed collar ends having internal threads, each of said collar ends being configured to threadedly receive one of said externally threaded members of said first and second crank members therewithin;

said collar and said externally threaded members of said first and second crank members being journalled through said internal bore of said bearing for rotation therewithin;

said support bar further comprising a four-way connector disposed intermediate said first and second ends of said support bar, said four-way connector including respective first, second, third, and fourth connectors disposed such that said first and second connectors are aligned with and connected to said first and second ends of said support bar, respectively, and said third and fourth connectors are disposed transverse to said first and second connectors, forming said bearing, wherein said collar and said externally threaded members of said first and second crank members are disposed for rotation within said third and fourth connectors.

2. The cycle of claim 1 wherein said support bar and said first and second cross members comprise hollow tubes having a circular cross section.

3. The cycle of claim 2, wherein said tubes are made from a strong, lightweight, plastic material.

* * * * *